US005257920A

United States Patent [19]

Takeda

[11] Patent Number: 5,257,920

[45] Date of Patent: Nov. 2, 1993

[54] SCROLL TYPE COMPRESSOR HAVING A CENTERED OPENING TO A HIGH PRESSURE CHAMBER

[75] Inventor: Kimiharu Takeda, Nishikasugai, Japan

[73] Assignee: Mitsubishi Jukogyo Kabushiki Kaisha, Tokyo, Japan

[21] Appl. No.: 800,276

[22] Filed: Dec. 2, 1991

[30] Foreign Application Priority Data

Apr. 25, 1991 [JP] Japan ..... 3-124819

[51] Int. Cl.[5] ..... F04C 18/04

[52] U.S. Cl. ..... 418/55.1; 418/55.2; 418/55.5; 418/57

[58] Field of Search ..... 418/55.2, 55.5, 57, 418/55.1

[56] References Cited

U.S. PATENT DOCUMENTS 3,874,827 4/1975 Young ..... 418/55.5
3,924,977 12/1975 McCullough ..... 418/55.5
4,571,163 2/1986 Sakamoto et al. ..... 418/57
4,609,334 9/1986 Muir et al. ..... 418/55.5
4,877,382 10/1989 Caillat et al. ..... 418/55.5
5,022,834 6/1991 Etemad et al. ..... 418/55.1

FOREIGN PATENT DOCUMENTS 58-167893 10/1983 Japan ..... 418/55.5
2194291 3/1988 United Kingdom .

*Primary Examiner*—John J. Vrablik
*Attorney, Agent, or Firm*—Birch, Stewart, Kolasch & Birch

[57] ABSTRACT

So as to decrease fluctuations in gas pressures acting on the external surface of an end plate by decreasing the area ratio of a high pressure chamber disposed on the outside of the end plate of a fixed scroll to a back pressure chamber, a scroll type compressor has one opening of the discharge port to the high pressure chamber provided in the end plate so as to coincide with the center of the spiral-shaped wrap.

4 Claims, 2 Drawing Sheets

SCROLL TYPE COMPRESSOR HAVING A CENTERED OPENING TO A HIGH PRESSURE CHAMBER

BACKGROUND OF THE INVENTION

1. Field of the Invention

The present invention relates to a scroll type compressor.

2. Description of Related Art

FIG. 3 shows an example of a conventional scroll type compressor. As shown in FIG. 3, a scroll type compressor mechanism C is arranged at the upper area inside a sealed housing 8, and an electric motor M is laid out at the lower area of this housing.

The scroll type compressor mechanism C is composed of a fixed scroll 1, an orbiting scroll 2, a rotation preventive mechanism 3, such as Oldham's coupling (link), that permits the revolution of the orbiting scroll 2 but prevents its rotation around its own axis, a frame 6 to which the fixed scroll 1 and the electric motor M are attached, an upper bearing 71 and a lower bearing 72 for supporting a rotary shaft 5, a rotation bearing 73 and a thrust bearing for supporting the orbiting scroll 2, and the like.

The fixed scroll 1 is equipped with an end plate 11 and a spiral-shaped wrap 12 erected on the internal surface of said plate 11, and supported by the frame 6 movably along the axial direction for its free movement through a spring 18.

The orbiting scroll 2 is provided with an end plate 21 and a spiral-shaped wrap 22 erected on the internal surface of said plate 21, and a drive bush 25 is rotatably fitted inside a boss 23 erected on the outer surface of said end plate 21 via a rotation bearing 73. An eccentric pin 53 protruding from the upper end of the rotary shaft 5 is rotatably fitted inside an eccentric hole provided on this drive bush 25. A balance weight 84 is mounted on the upper end of the rotary shaft 5.

The fixed scroll 1 and the orbiting scroll 2 are engaged with each other with an eccentric throw corresponding to the radius of revolution and with an angular shift of 180° between them. With this engagement, a plurality of compression chambers 24 are formed with a point symmetry with respect to the center axis P of the spiral-shaped wrap 12 of the fixed scroll 1.

A discharge port 13 is provided at the center area of the end plate 11 of the fixed scroll 1, and one end of this discharge port 13 communicates with an innermost chamber 26 (formed immediately before the point where the base ends of spiral-shaped wraps 12 and 22 depart from the corresponding side spiral-shaped wraps 22 and 12, respectively).

Cylindrical bosses 46 and 47 are provided concentrically on the outer surface of the end plate 11, and the tips of these bosses 46 and 47 are slidably engaged via a seal 42 to a partition plate 41 which is fixed to the sealed housing 8 with an interposed space to the end plate 11. Thus, a high pressure chamber 44 is formed in the central area on the outside of end plate 11, and an annular back pressure chamber 45 is formed around this high pressure chamber A discharge port 13 opens to this high pressure chamber 44, while a negative pressure chamber 45 communicates gas via a through hole 19 to a compression chamber which is in the process of compression.

The orbiting scroll 2 is driven via a turning drive mechanism, such as the rotary shaft 5, an eccentric pin 53, a dry bush 25, a boss 23 and the like by the electric motor M, whereas the orbiting scroll 2 makes a revolution motion on a circular orbit with a revolution turning radius while the rotation around its own axis is prevented by the rotation preventive mechanism 3.

Then, the gas enters into the sealed housing 8 through a suction pipe 82, and after cooling down the electric motor M, it passes through a channel 85 provided on the frame 6 and also through a suction chamber 16 from a suction channel 15 and is sucked into the compression chambers 24 from the external end openings of the spiral-shaped wraps 12 and 22. The gas reaches an innermost chamber 26 located in the central area while it is compressed as the volume of the compression chamber 24 decreases due to the revolution of the orbiting scroll 2. It then passes through the discharge port 13 to discharge into the high pressure chamber 44, and enters into a discharge cavity 48 through a hole 43 provided on the partition plate 41, and is finally discharged to the outside via a discharge pipe 83.

At the same time, lubricating oil 81 which is stored at the inner bottom of the housing 8 is sucked up by a centrifugal pump 51 installed in a lower portion inside the rotary shaft 5, and after lubricating the lower bearing 72, the eccentric pin 53, the upper bearing 71, the rotation preventive mechanism 3, the rotation bearing 73, the thrust bearing 74, and the like through an oiling port 52, it returns to the bottom of the sealed housing 8 via a chamber 61 and an oil discharge port 62, and is stored therein.

Further, because the discharged gas under high pressure is introduced into the high pressure chamber 44 under the revolution motion of the orbiting scroll 2 and the medium pressure gas in the process of compression is introduced into the back pressure chamber 45, the end plate 11 is pressed downward by the gas pressures inside the high pressure chamber 44 and back pressure chamber 45. The tip surfaces of spiral-shaped wraps 12 and 22 are pressed with an adequate contact pressure against the internal surfaces of end plates 21 and 11, so as to maintain each of a plurality of compression chambers 24 in sealed conditions.

Also, the high pressure chamber 44 and back pressure chamber 45 are formed concentrically with respect to the center axis P of the spiral-shaped wrap 12 as a center. This is because, if the center of urging pressure forces acting on the end plate 11 due to gas pressures do not coincide with the center axis P of the spiral-shaped wrap 12, an overturning moment occurs which prevents the tip surfaces of the spiral-shaped wraps 12 and 22 from being pressed with a uniform contact pressure against the internal surfaces of the end plate 21 and 11, thereby causing the defective sealing of the compression chambers 24.

This conventional scroll type compressor makes an adequate pressing force acting on the end plate 11 by appropriately setting the pressure receiving areas of the high pressure chamber 44 and back pressure chamber 45, but in order to decrease fluctuations of the pressuring forces which accompany pressure changes in the compression chamber 24 to a minimum level, the pressure receiving area of the high pressure chamber 44 should preferably be made smaller than that of the back pressure chamber 45. In other words, it is preferred that the area ratio of the high pressure chamber 44 be made smaller.

However, because the discharge port 13 is provided at a position shifted sideways from the center axis P of the spiral-shaped wrap 12 and the pressure receiving area of the high pressure chamber 44 is set to a large size so as to include this discharge port 13, the area ratio of the high pressure chamber 44 is large and the pressing force acting on the end plate 11 fluctuates greatly. As a result, if the pressing force becomes too small, the sealing of the compression chambers 24 becomes insufficient. On the other hand, if the pressing force becomes excessive, frictional forces between the tip surfaces of the spiral-shaped wraps 12 and 22 and the internal surfaces of the end plates 21 and 11 increases, thereby causing trouble such as power loss of the compressor.

OBJECT AND SUMMARY OF THE INVENTION

An object of this invention is to solve the above-described problems.

The gist of this invention resides in a scroll type compressor comprising: a fixed scroll which is formed by erecting a spiral-shaped wrap on an internal surface of an end plate; an orbiting scroll; the fixed scroll and the orbiting scroll being engaged with an angular displacement and with an eccentric throw between each other; a plurality of compression chambers formed with a point-symmetry with respect to a center axis of the spiral-shape of the fixed scroll; the fixed scroll and the orbiting scroll being supported movably in the direction of the axis; a high pressure chamber with a discharge port which opens at an outer center portion of the end plate; and a back pressure chamber which surrounds the high pressure chamber and into which gas in a compression process is introduced; the opening of the discharge port to the high pressure chamber being positioned substantially at the center of the spiral-shaped wrap.

In this invention, because the opening of the discharge port to the high pressure chamber is positioned at the center of the spiral-shaped wrap, not only can the pressure receiving area of the high pressure chamber which is formed around the center axis of this spiral-shaped wrap be made smaller, but also the pressure receiving area of the back pressure chamber can be expanded. As a result, it is possible to decrease fluctuations in pressing forces onto the end plates due to the gas pressures in the high pressure chamber and the back pressure chamber.

DETAILED DESCRIPTION OF PREFERRED EMBODIMENTS

Figure 1:
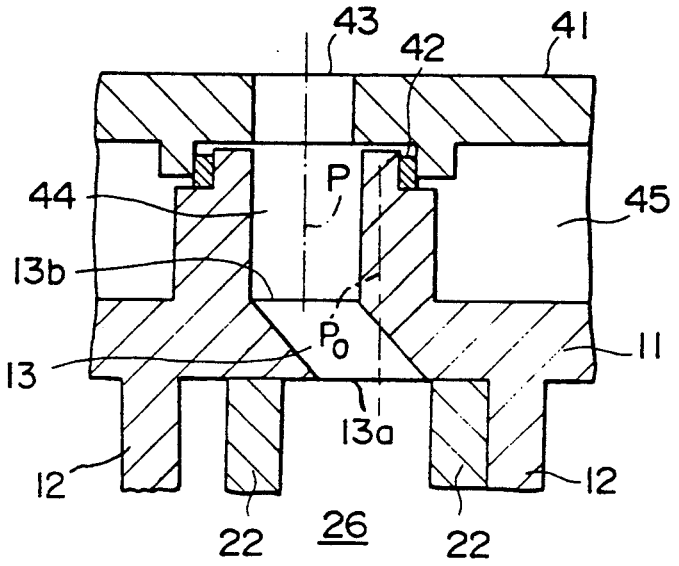
FIG. 1 is a partial sectional view of a scroll type compressor according to a first embodiment of this invention.

FIG. 1 is a partial sectional view of a scroll type compressor according to the first embodiment of the present invention.

The discharge port 13 is inclined, and its opening 13*a* on one end, namely, an opening to the innermost chamber 26, is shifted sideways from the center axis P of the spiral-shaped wrap 12. Thus, the opening 13*a* of the discharge port 13 formed in the end plate 11 of the fixed scroll 1 communicates with the inner most chamber 26 which is formed just before the point where the base ends of spiral-shaped wraps 12 and 22 depart from the counterpart wraps 22 and 12 respectively, and the center $P_0$ of said opening 13*a* is positioned as shifted sideways from the center axis P of the spiral-shaped wrap 12 in the center area. Another opening 13*b* on the other end, namely, an opening to the high pressure chamber 44, is arranged so that its center coincides with the center axis P of the spiral-shaped wrap 12. Thus, the opening 13*b* of the discharge portion 13 communicates with the high pressure chamber 44 formed at the external surface of the end plate 11, and the center of the opening coincides with the central axis P of the spiral-shaped wrap 12. Accordingly, the positions of both openings 13*a* and 13*b* of the discharge port 13 are shifted by the distance between center $P_0$ of the opening 13*a* and the center axis P of the spiral-shaped wrap 12. Such various items as the channel area and the opening 13*a* and 13*b* of the discharge port 13 are set so that the flow resistance of gas passing through the discharge port may become smaller than a permissible level The high pressure chamber 44 and the back pressure chamber 45 are formed concentrically around the center axis of the spiral-shaped wrap 12, and the diameter of the high pressure chamber 44 is set equal to that of the opening 13*b* and made smaller than that of the conventional high pressure chamber shown in FIG. 3.

Figure 3:
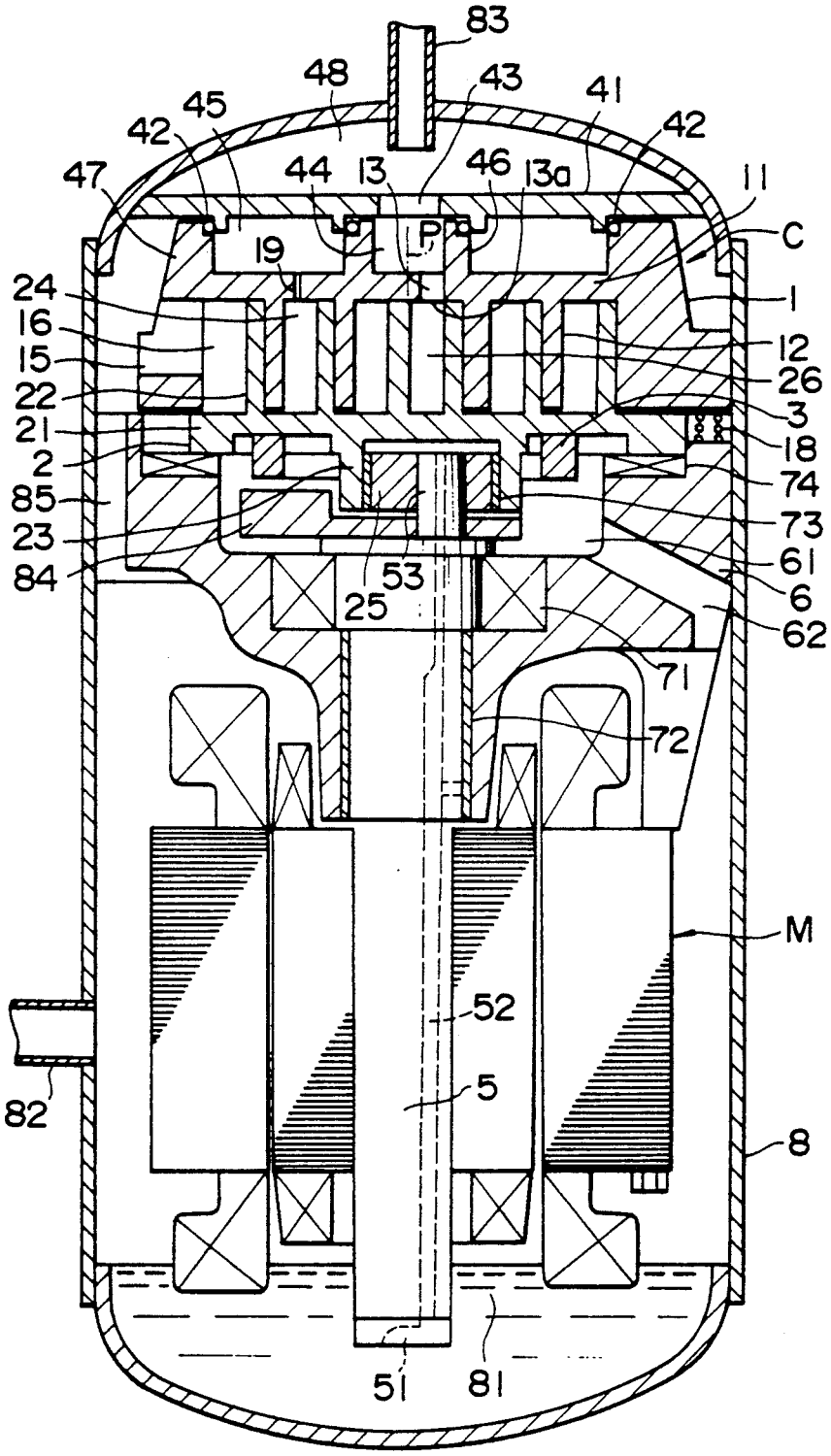
FIG. 3 PRIOR ART
FIG. 3 is a sectional view showing a conventional scroll type compressor.

The other structural features are similar to those of the conventional one shown in FIG. 3. The same symbols are given to the corresponding members and their explanations are omitted.

In this way, because the center of the opening 13*b* to the high pressure chamber interior 44 of the discharge port 13 coincides with the central axis P of the spiral-shaped wrap 12, the high pressure chamber 44 may be formed so as to include the opening 13*b* around the center axis P as its center. Therefore, because the pressure receiving area of the high pressure chamber 44 can be made smaller and the pressure receiving area of the back pressure chamber 45 can be expanded accordingly, the area ratio of the back pressure chamber 45 can be increased. Thus, it is possible to decrease the fluctuations of pressing forces against the end plate 11 due to the gas pressures inside the high pressure chamber 44 and the back pressure chamber 45.

Although the center of the opening 13*b* is made to coincide with the center axis P in the above embodiment, this invention is by no means restricted to this arrangement. The opening 13*b* can be formed as close as possible to the center axis P so as to include the center axis.

Furthermore, the discharge port 13 can also be provided on the end plate 11 of the spiral scroll 12, and the high pressure chamber 44 and back pressure chamber 45 can be arranged on the outside of the outside of end plate 11.

Figure 2:
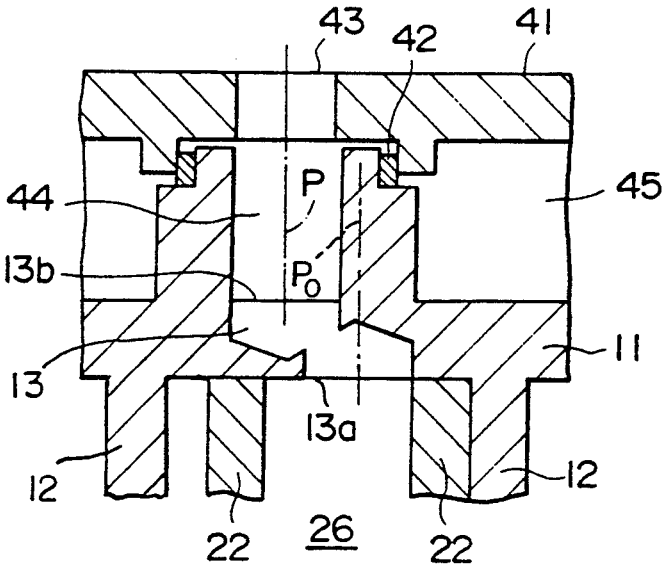
FIG. 2 is a partial sectional view of scroll type compressor according to a second embodiment of this invention.

FIG. 2 shows another embodiment, wherein vertical holes are bored from the internal surface and external surface of the end plate 11 so that these holes communicate mutually each other inside the end plate 11. The discharge port 13 can be machined more easily this way.

Other structures and actions are identical to those of the first embodiment shown in FIG. 1, and the same symbols are given to the corresponding members, and their explanations are omitted.

In this invention, because the opening to the high pressure chamber of the discharge port provided in the end plate is positioned at the center of the spiral-shaped wrap, the pressure receiving area of the high pressure chamber can be made smaller, and moreover the pressure receiving area of the back pressure chamber can be expanded, so the area ratio of the back pressure chamber increases. Because it is possible to reduce fluctuations in pressing pressure forces against the end plate due to the gas pressures inside the high pressure chamber and the back pressure chamber in this manner, not only are the sealing conditions of the compression chambers maintained favorably, but power consumption losses of the compressor can also be prevented.

I claim:

1. A scroll type compressor comprising:

a fixed scroll having a spiral-shaped wrap set on an internal surface of an end plate thereof, said fixed scroll being supported by a frame member to enable free movement along the direction of its axis;

an orbiting scroll having a spiral-shaped wrap set on an end plate thereof, said fixed scroll and said orbiting scroll being engaged with an angular displacement therebetween and in an eccentric manner so as to form a plurality of compression chambers having a point-symmetry with respect to a central axis of the spiral-shaped wrap of said fixed scroll;

means for forming a high pressure chamber on an external surface of the end plate of said fixed scroll;

a discharge port including first and second openings, the first opening of said discharge port mating with an opening of said high pressure chamber t an axial center portion of the spiral-shaped wrap set on the end plate of said fixed scroll;

means for forming a back pressure chamber around said high pressure chamber for conducting gas half-way through its compression into said back pressure chamber;

wherein said high pressure chamber and said back pressure chamber are formed concentrically around the central axis of the spiral-shaped wrap of said fixed scroll, the second opening of said discharge port being offset from the central axis of said spiral-shaped wrap at the side of an innermost one of said plurality of compression chambers of the end plate of said fixed scroll being in fluid communication through a passage inclined with respect to the central axis of the spiral-shaped wrap of said fixed scroll.

2. The scroll type compressor according to claim 1, wherein a diameter of said high-pressure chamber is equal to the corresponding first opening of said discharge port.

3. The scroll type compressor according to claim 2, wherein a pressure receiving area of said back pressure chamber is greater than a pressure receiving area of said high pressure receiving chamber.

4. The scroll type compressor according to claim 1, wherein the eccentric manner of engagement of said fixed scroll and said orbiting scroll corresponds to a radius of revolution and with an angular shift of 180° therebetween.

* * * * *